US010633879B2

(12) United States Patent
Hassard

(10) Patent No.: US 10,633,879 B2
(45) Date of Patent: Apr. 28, 2020

(54) HOT TUB COVER MOISTURE PROTECTOR

(71) Applicant: Nick Frank Hassard, Kelowna (CA)

(72) Inventor: Nick Frank Hassard, Kelowna (CA)

( * ) Notice: Subject to any disclaimer, the term of this patent is extended or adjusted under 35 U.S.C. 154(b) by 0 days.

(21) Appl. No.: 16/109,488

(22) Filed: Aug. 22, 2018

(65) Prior Publication Data

US 2020/0063453 A1 Feb. 27, 2020

(51) Int. Cl.
*E04H 4/08* (2006.01)

(52) U.S. Cl.
CPC ..... *E04H 4/08* (2013.01)

(58) Field of Classification Search
CPC ..... A61H 33/10; B63B 17/02–023; E03B 2001/047; E04H 4/08–108; F16B 35/041
USPC ..... 220/373; 411/395, 418
See application file for complete search history.

(56) References Cited

U.S. PATENT DOCUMENTS 4,028,750 A * 6/1977 Gustafsson ..... E04H 4/10 4/498
4,820,097 A * 4/1989 Maeda ..... F02K 1/80 165/134.1
5,143,014 A * 9/1992 Gabison ..... B63B 13/00 114/361
5,373,590 A * 12/1994 Svae ..... E04H 4/105 4/498
6,954,947 B1 * 10/2005 Williams, Jr. ..... E04F 17/026 4/218
2008/0083062 A1 * 4/2008 Chase ..... E04H 4/08 4/498
2009/0151065 A1 * 6/2009 Watson ..... E04H 4/0025 4/503
2014/0352842 A1 * 12/2014 McEvilly ..... E04H 15/04 141/69
2017/0295729 A1 * 10/2017 Cabezas Alamos ... A01G 22/00

FOREIGN PATENT DOCUMENTS

CA 2114079 * 7/1995 ..... A61H 33/006
GB 2466007 * 9/2010 ..... E04H 4/08

* cited by examiner

*Primary Examiner* — Erin Deery
*Assistant Examiner* — Nicholas A Ros

(57) ABSTRACT

An apparatus, method and kit for controlling moisture under a hot tub cover comprising a planar sheet of flexible material having a peripheral edge corresponding to the shape of the hot tub cover, a plurality of connectors extending from the peripheral edge adapted to engage with the hot tub cover and at least one aperture through the planar sheet. The method comprising locating a planar sheet of flexible material having a peripheral edge corresponding to the shape of the hot tub cover to an undersurface of the hot tub cover, securing the planar sheet to the hot tub cover with a plurality of connectors extending from the peripheral edge adapted to engage with the hot tub cover, and draining moisture on a top surface of the planar sheet through at least one aperture through the planar sheet. The may be secured to a hot tub cover.

9 Claims, 4 Drawing Sheets

HOT TUB COVER MOISTURE PROTECTOR

BACKGROUND OF THE INVENTION

1. Field of Invention

The present invention relates generally to hot tubs and in particular a protector for the inside of a hot tub cover.

2. Description of Related Art

When not in use, hot tubs are typically covered with a solid foam member enclosed in a fabric material to insulate the hot water, as well as to prevent entry to the tub by debris, insects, animals or children. The cover is positioned over the entirety of the hot tub, spaced apart from the surface of the water. Within the enclosed space between the cover and the hot water, condensation forms on the underside of the cover. Over time, the condensed water, with contained spa chemicals, can break down the integrity of the cover fabric and penetrate through to the foam member within. The absorbed water is retained within the foam, increasing the weight of the cover and resulting in damage to the fabric surrounding the foam, eventually requiring an expensive cover replacement.

SUMMARY OF THE INVENTION

According to a first embodiment of the present invention there is disclosed an apparatus for controlling moisture under a hot tub cover comprising a planar sheet of flexible material having a peripheral edge corresponding to the shape of the hot tub cover, a plurality of connectors extending from the peripheral edge adapted to engage with the hot tub cover and at least one aperture through the planar sheet having a size selected to permit water to pass therethrough.

The at least one aperture may include a funnel formed therearound in the planar sheet. The funnel may be formed of a secondary sheet of flexible material having a secondary aperture formed therethrough corresponding to the at least one aperture through the planar sheet. The secondary sheet of flexible material may have a slit cut from an exterior edge thereof to an aperture in a middle thereof wherein edges adjacent to the slit are overlapped to form the secondary sheet into the funnel.

The at least one aperture may include a drain body passing therethrough. The drain body may include at least one drain passage therethrough. The at least one drain passage may include an entrance and an exit with a middle trap portion therebetween. The drain body may be formed of an inner body and an outer body threadably secured around the inner body. The inner body may include a bore axially therethrough. The inner body may include exterior threading therearound wherein at least a portion of the exterior threading has been removed to permit fluid to flow between the inner and outer bodies.

According to a further embodiment of the present invention there is disclosed a method for controlling moisture under a hot tub cover comprising locating a planar sheet of flexible material having a peripheral edge corresponding to the shape of the hot tub cover to an undersurface of the hot tub cover, securing the planar sheet to the hot tub cover with a plurality of connectors extending from the peripheral edge adapted to engage with the hot tub cover, and draining moisture on a top surface of the planar sheet through at least one aperture through the planar sheet.

According to a further embodiment of the present invention there is disclosed a hot tub cover kit comprising a hot tub cover, a planar sheet of flexible material having a peripheral edge corresponding to the shape of the hot tub cover, a plurality of connectors extending from the peripheral edge adapted to engage with the hot tub cover and at least one aperture through the planar sheet having a size selected to permit water to pass therethrough.

Other aspects and features of the present invention will become apparent to those ordinarily skilled in the art upon review of the following description of specific embodiments of the invention in conjunction with the accompanying figures.

BRIEF DESCRIPTION OF THE DRAWINGS

In drawings which illustrate embodiments of the invention wherein similar characters of reference denote corresponding parts in each view.

DETAILED DESCRIPTION

Figure 1:
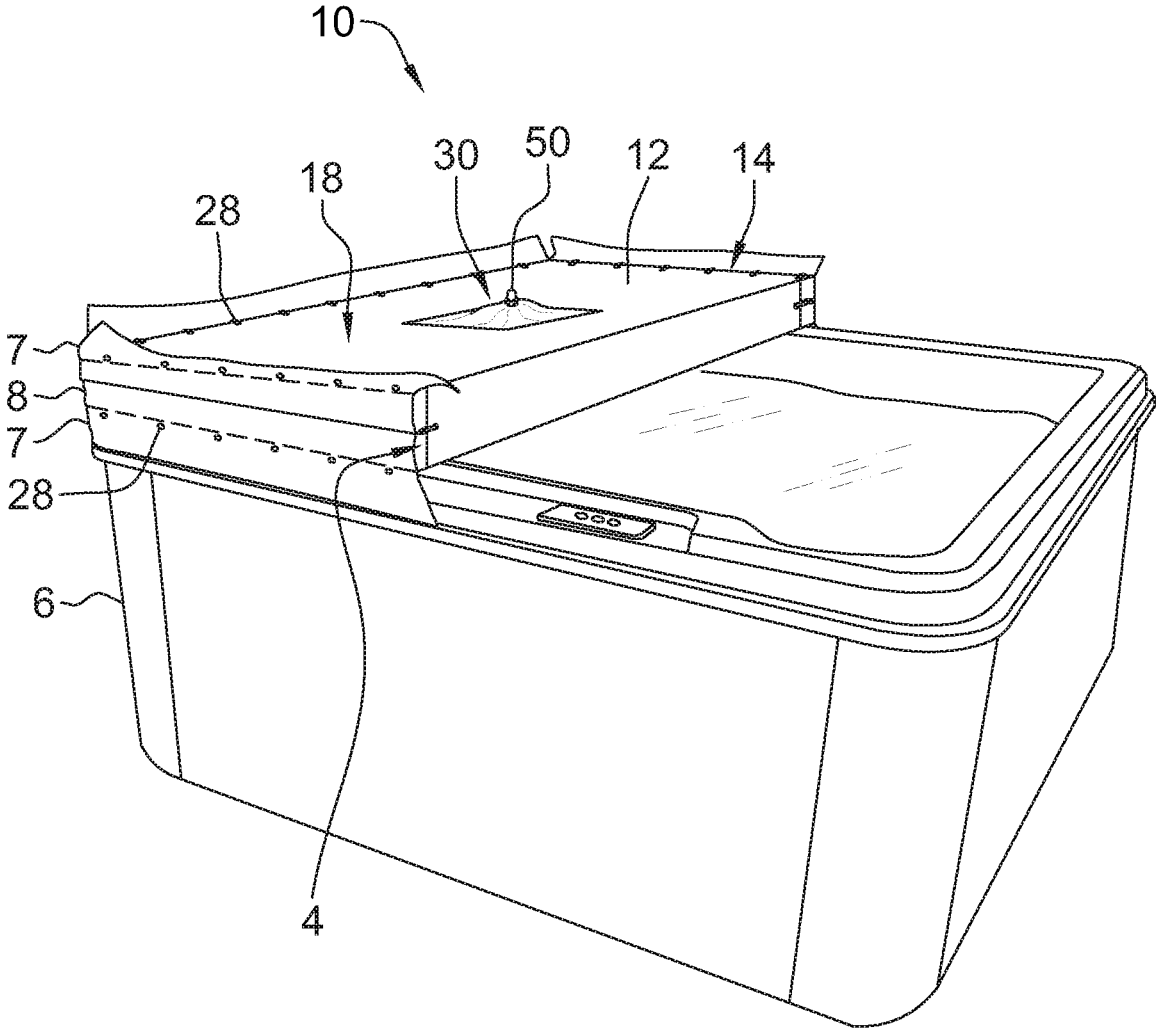
FIG. 1 is a perspective view of a hot tub and hot tub cover with an apparatus for controlling moisture under a hot tub cover attached thereto according to a first embodiment of the present invention.

Referring to FIG. 1, an apparatus for controlling moisture under a hot tub cover according to a first embodiment of the invention is shown generally at 10 secured to the underside of a hot tub cover 8 resting on the top of a hot tub 6. The hot tub cover 8 includes skirting 7 therearound, as is commonly known. As illustrated, the hot tub cover 8 is folded open on one side. It will be appreciated that hot tub covers 8 may fold, as shown, or they may be formed without a folding portion. The hot tub cover 8 shown is provided for illustration purposes only. It will also be appreciated that the apparatus 10 may be secured to a cover for any body of water, such as a pool cover, a spa cover, and the like, or the apparatus 10 may be co-formed with a cover.

Figure 2:
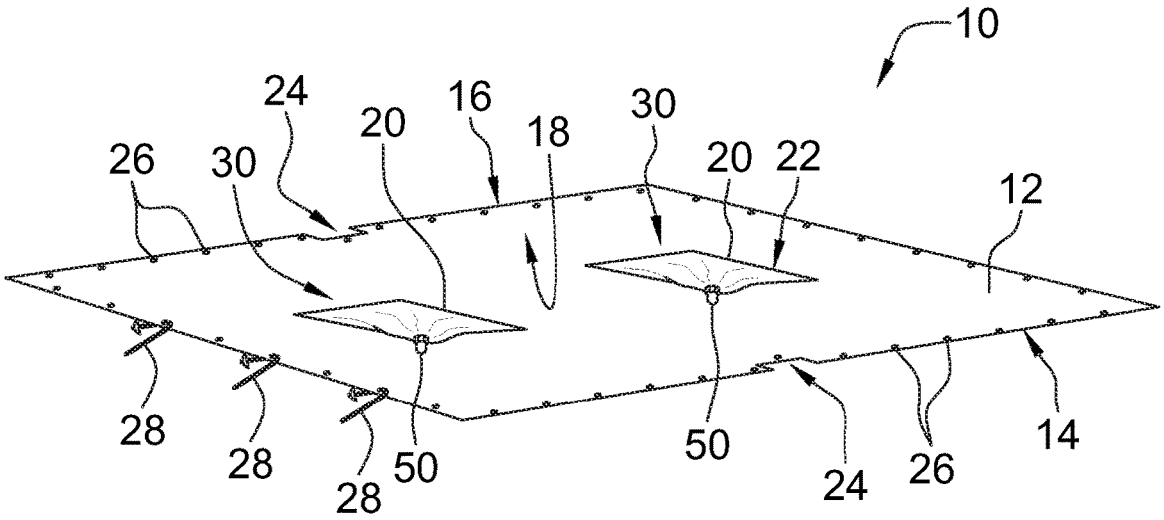
FIG. 2 is a perspective bottom view of the apparatus of FIG. 1.
Figure 3:
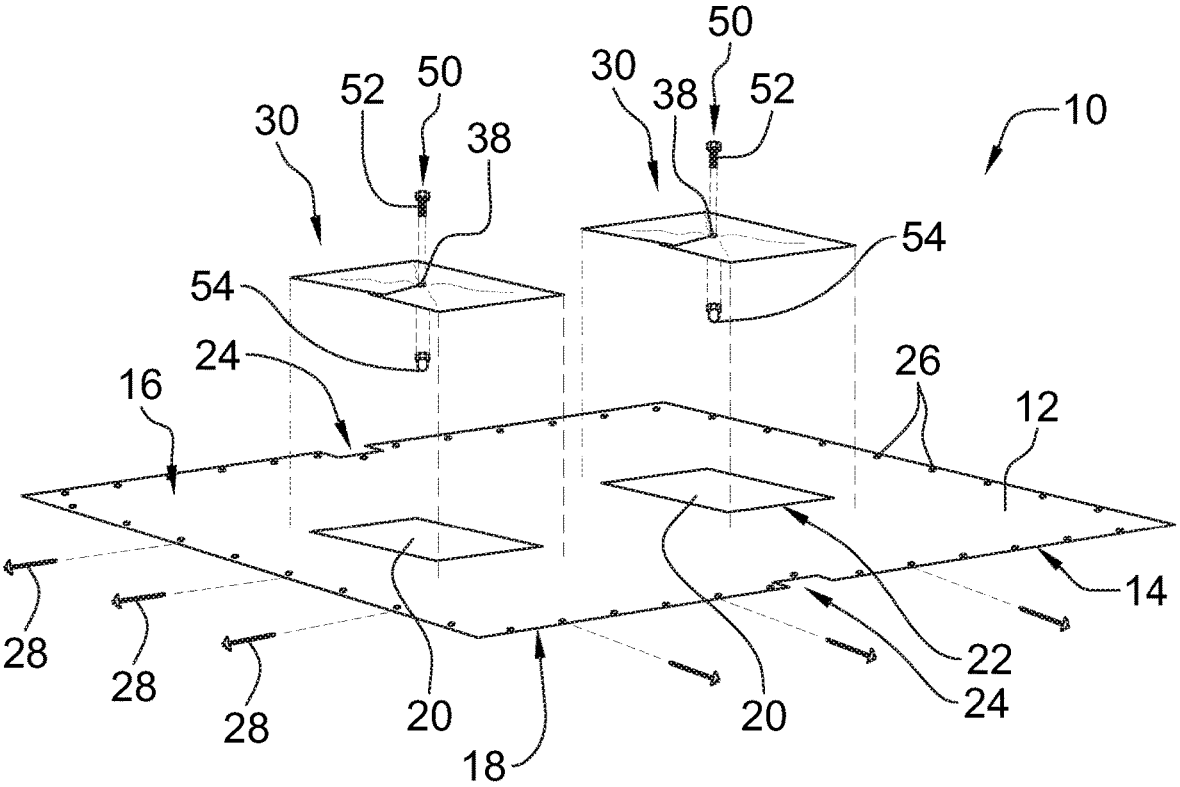
FIG. 3 is an exploded perspective view of the apparatus of FIG. 1.

Referring now to FIGS. 1 through 3, the apparatus 10 comprises a planar sheet 12 having a peripheral edge 14 with at least one funnel 30 therein. Each funnel 30 includes an aperture 38 therethrough, as best illustrated in FIG. 3, sized to receive a drain body 50 therein operable to drain moisture therethrough in one direction only, as will be more fully described below.

The planar sheet 12 has top and bottom surfaces 16 and 18, respectively, and includes at least one opening 20 therethrough sized to receive a portion of a funnel 30 therethrough. The opening 20 may be formed with a square shaped opening edge 22 corresponding with a square funnel 30, although it will be appreciated that other shapes, such as circular or oval, may be used, as well. The peripheral edge 14 is formed with a size and shape to correspond to the underside of a hot tub cover 8, as is commonly known, and may include a pair of notches 24 to correspond with a folding portion 4 of the hot tub cover 8, as illustrated in FIG.

1. A plurality of mounting holes 26 sized to receive a fastener 28 therethrough are distributed around the planar sheet 12 proximate to the peripheral edge 14. The fasteners 28 may comprise button head cable tie fasteners, or any other commonly known fasteners such as, for example, tie straps or the like, as are commonly known, and are used to secure the apparatus 10 to the hot tub cover 8 by passing through slits or holes (not shown) formed in the skirting 7. The planar sheet 12 may be formed with a high strength synthetic woven fabric having a thick coating of chemical resistant polyvinyl chloride (PVC) applied to each side to prevent moisture from passing therethrough. It will be appreciated that any other flexible and water proof material may also be used for the planar sheet. It will be appreciated that mounting holes 26 and fasteners 28 may not be necessary in the case where the apparatus 10 is co-formed with a hot tub cover 8.

Figure 4:
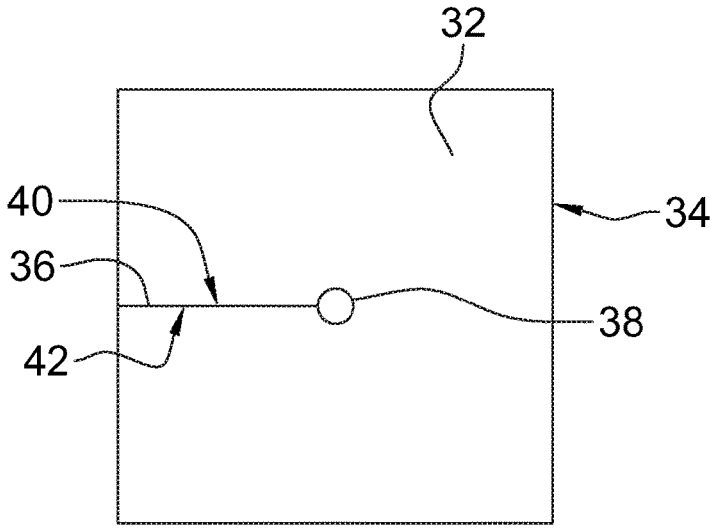
FIG. 4 is a top view of a slit funnel panel.
Figure 5:
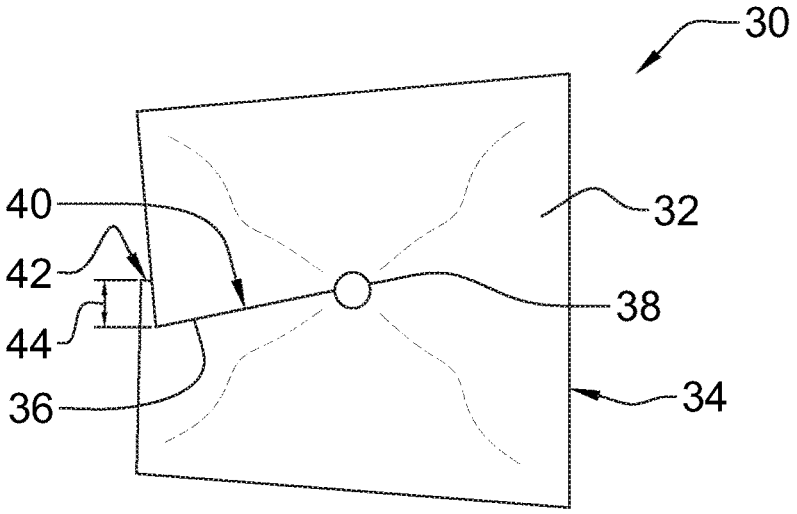
FIG. 5 is a top view of a funnel panel with the slit edges overlapping.
Figure 6:
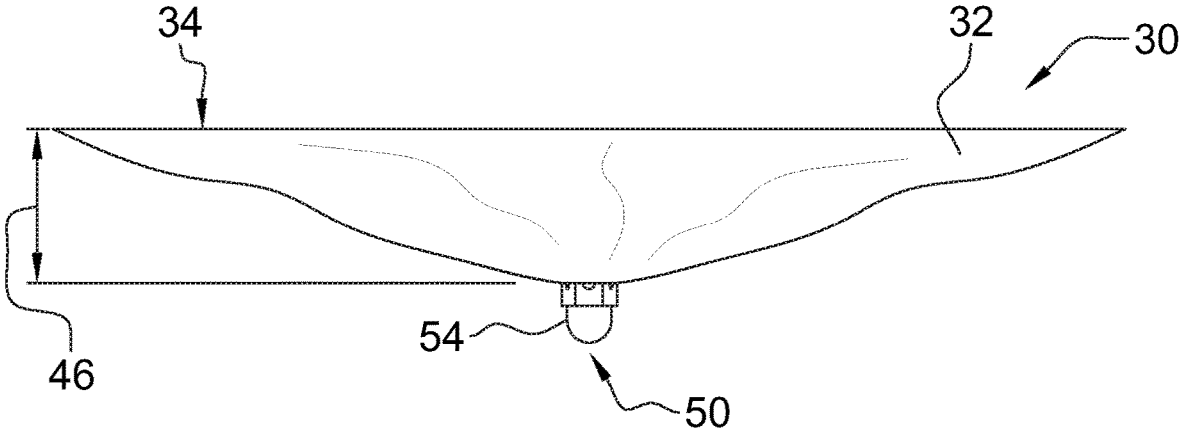
FIG. 6 is a side view of a funnel.

Turning now to FIGS. 4 through 6, the funnel 30 is formed with a planar funnel panel 32 using material corresponding to the material used for the planar sheet 12 as set out above. The funnel panel 32 has a peripheral edge 34 with a slit 36 extending from the peripheral edge 34 to the central aperture 38. The slit 36 has first and second edges 40 and 42. The funnel 30 is formed by overlapping and adhering the first edge 40 over the second edge 42, by an adhesive, welding or any other method as is commonly known, and as illustrated in FIG. 5, by an overlap distance 44 as measured proximate to the peripheral edge 34. The depth of the funnel 30, as illustrated generally at 46 on FIG. 6, corresponds to the size of the overlap distance 44, with a larger overlap distance 44 resulting in a larger funnel depth 46. The size and shape of the funnel panel 32 is selected such that the peripheral edge 34 of the funnel panel 32 overlaps the opening edge 22 of the opening 20 by an overlap distance in the range of, such as, by way of non-limiting example, ¾" to 1½" (20 mm to 40 mm). The funnel 30 is inserted into the opening 20 and adhered to the top surface 16 of the planar sheet 12 with an adhesive, welding or any other known method as best illustrated in FIGS. 2 and 3, forming a watertight seal between the funnel 30 and the planar sheet 12. Although the funnel 30 is illustrated as being formed with a planar funnel panel 32, it will be appreciated that the funnel 30 could be formed as one piece without a slit 36 or co-formed with the planar sheet 12, as is commonly known.

Figure 7:
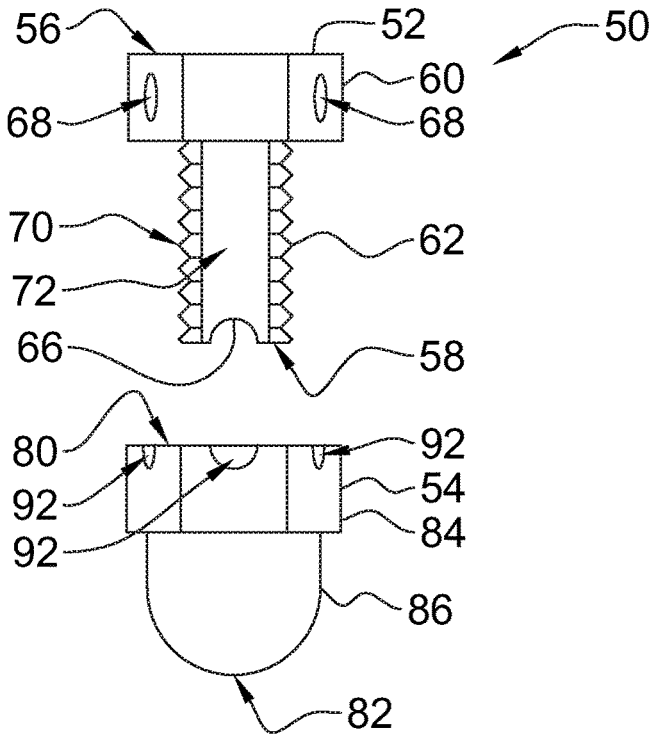
FIG. 7 is an exploded side view of a drain body
Figure 8:
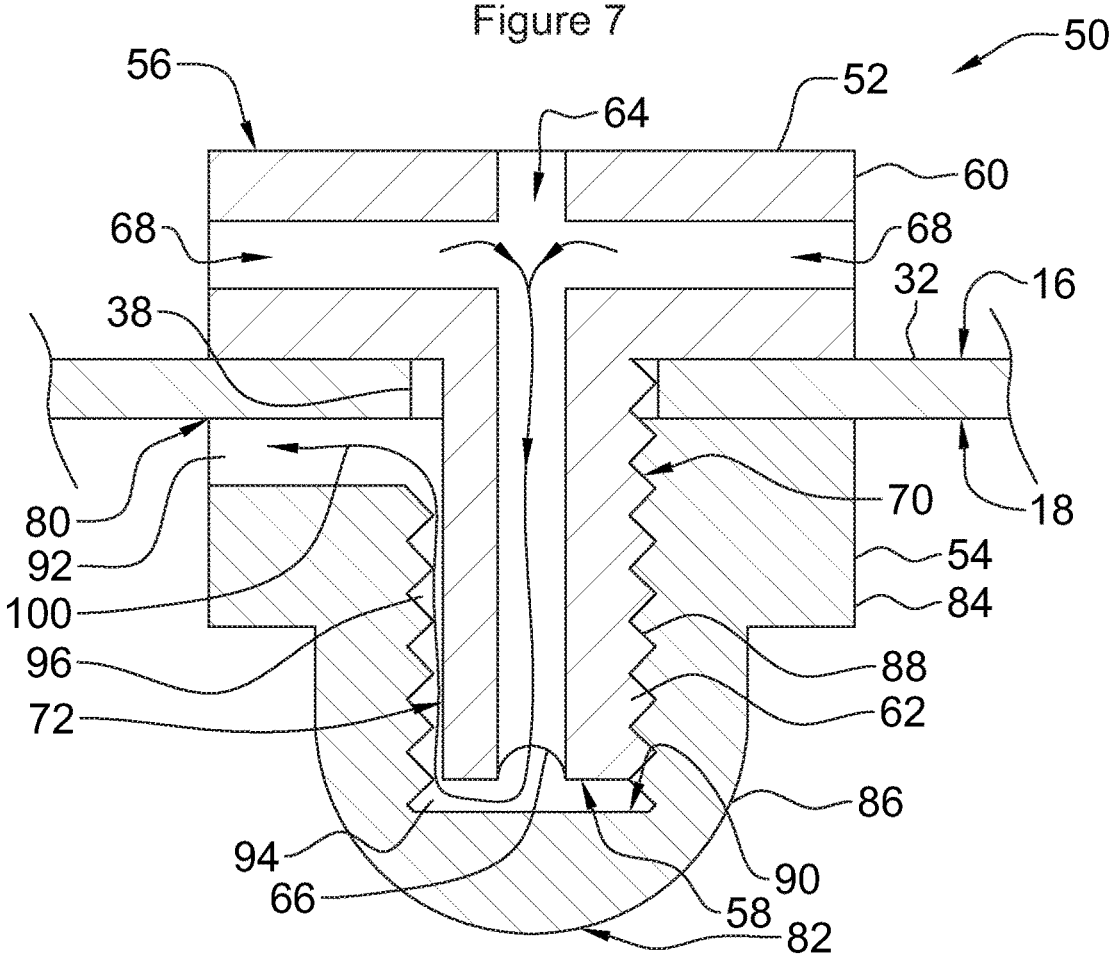
FIG. 8 is a side cross sectional view of a drain body.

Referring now to FIGS. 3, 7 and 8, the drain body 50 is comprised of upper and lower drain bodies, 52 and 54, respectively. The upper drain body 52 is formed using a bolt and the lower drain body 54 is formed using an acorn nut, as is commonly known. The upper and lower drain bodies 52 and 54 may be formed with a plastic material, such as, by way of non-limiting example, nylon or any other suitable material such as metals.

The upper drain body 52 extends between top and bottom surfaces, 56 and 58, respectively, and is comprised of a head 60 extending from the top surface 56 and a shank 62 extending from the head 60 to the bottom surface 58. The upper drain body 52 is selected such that the shank 62 corresponds with the aperture 38 in the funnel 30. A central passage 64 extends axially through the upper drain body 52, extending through the top surface 56 to a notch 66 in the bottom surface 58. A plurality of horizontal drain passages 68 extend through the head 60 and intersect with the central passage 64. The shank 62 is formed with at least one threaded portion 70 selected to correspond with the lower drain body 54, as will be set out below, and at least one narrowed thread bypass portion 72. The thread bypass portion 72 may be formed by removing a portion of the threading on the shank 62 of a standard bolt.

The lower drain body 54 extends between top and bottom surfaces, 80 and 82, respectively, and is comprised of a head 84 extending from the top surface 80 and a crown 86 extending from the head 84 to the bottom surface 82. A threaded blind bore 88 extends axially from the top surface 80 to a bore end 90 in the crown 86. The threaded blind bore 88 corresponds with the threaded portion 70 of the shank 62 on the upper drain body 52. At least one horizontal drain passage 92 extends through the head 84 and intersects with the blind bore 88. For illustrative purposes, FIG. 7 illustrates a plurality of horizontal drain passages 92, whereas FIG. 8 illustrates one horizontal drain passage 92.

The upper drain body 52 is passed through the aperture 38 in the funnel panel 32 from the top surface 16 and the shank 62 is secured within the blind bore 88 of the lower drain body 54 located proximate to the bottom surface 18, compressing the funnel panel 32 between the upper and lower drain bodies 52 and 54. A trap 94 is formed between the bottom surface 58 of the upper drain body 52 and the bore end 90 of the lower drain body 54. At least one vertical drain passage 96 is formed between the thread bypass portion 72 of the shank 62 and the blind bore 88.

In operation, the apparatus 10 is secured to the skirting 7 on a hot tub cover 8 such that the top surface 16 is located proximate to the inside of the hot tub cover 8, as illustrated in FIG. 1. As set out above, the fasteners 28 are secured to the hot tub cover 8 through slits in the skirting 7. When the cover is closed, any water trapped between the hot tub cover 8 and the apparatus 10 drains by way of gravity into the at least one funnel 30 and into the upper drain body 52 through the horizontal drain passages 68 and through the central passage 64. The water then fills the trap 94 and raises the water level up through the vertical drain passage 96 and out of the lower drain body through the at least one horizontal drain passage 92, as indicated generally at 100. This drainage method is similar to a P-trap drain system as is commonly used in plumbing systems, which allows water to drain in one direction only, from the upper drain body 52 to the lower drain body 54 as indicated at 100 and prevents water from migrating up through the lower drain body 54 to the upper drain body 52 due to the water remaining within the trap 94 and vertical drain passage 96.

The hot tub cover 8 is protected from water condensation on the bottom surface 18 due to the impermeability of the material used to form the apparatus 10 as well as the water trapped within the lower drain body 54. By removing water from between the apparatus 10 and the hot tub cover 8 and by preventing condensation from forming on the hot tub cover 8, the hot tub cover 8 remains dry, thus preventing deterioration of the hot tub cover material and subsequent absorption by the internal foam core, thereby extending the life of the hot tub cover 8.

While specific embodiments of the invention have been described and illustrated, such embodiments should be considered illustrative of the invention only and not as limiting the invention as construed in accordance with the accompanying claims.

What is claimed is:

1. An apparatus for controlling moisture under a hot tub cover comprising:

a planar sheet of flexible material having a peripheral edge corresponding to the shape of the hot tub cover;

a plurality of connectors extending from said peripheral edge adapted to engage with the hot tub cover; and at least one aperture through said planar sheet having a size selected to permit water to pass therethrough, wherein said at least one aperture includes a drain body passing therethrough, wherein said drain body includes at least one drain passage therethrough having an entrance and an exit with a middle trap portion therebetween.

2. The apparatus of claim 1 wherein said at least one aperture includes a funnel formed therearound in said planar sheet.

3. The apparatus of claim 2 wherein said funnel is formed of a secondary sheet of flexible material having a secondary aperture formed therethrough corresponding to said at least one aperture through said planar sheet.

4. The apparatus of claim 3 wherein said secondary sheet of flexible material has a slit cut from an exterior edge thereof to an aperture in a middle thereof wherein edges adjacent to said slit are overlapped to form said secondary sheet into said funnel.

5. The apparatus of claim 1 wherein said drain body is formed of an inner body and an outer body threadably secured around said inner body.

6. The apparatus of claim 5 wherein said inner body includes a bore axially therethrough.

7. The apparatus of claim 5 wherein said inner body includes exterior threading therearound wherein at least a portion of said exterior threading has been removed to permit fluid to flow between said inner and outer bodies.

8. A hot tub cover kit comprising:

a hot tub cover;

a planar sheet of flexible material having a peripheral edge corresponding to the shape of said hot tub cover;

a plurality of connectors extending from said peripheral edge adapted to engage with said hot tub cover; and at least one aperture through said planar sheet having a size selected to permit water to pass therethrough, wherein said at least one aperture includes a drain body passing therethrough, wherein said drain body includes at least one drain passage therethrough having an entrance and an exit with a middle trap portion therebetween.

9. A method for controlling moisture under a hot tub cover comprising:

locating a planar sheet of flexible material having a peripheral edge corresponding to the shape of the hot tub cover to an undersurface of the hot tub cover;

securing said planar sheet to the hot tub cover with a plurality of connectors extending from said peripheral edge adapted to engage with the hot tub cover; and draining moisture on a top surface of said planar sheet through at least one aperture through said planar sheet, wherein said at least one aperture includes a drain body passing therethrough, wherein said drain body includes at least one drain passage therethrough having an entrance and an exit with a middle trap portion therebetween.

* * * * *